US005451192A

United States Patent [19]

Hefele

[11] Patent Number: 5,451,192

[45] Date of Patent: Sep. 19, 1995

[54] ADJUSTABLE EXERCISE DEVICE FOR A CHILD

[76] Inventor: Sheryn B. Hefele, 111 E. Papa Ave., Kahului, Hi. 96732

[21] Appl. No.: 210,495

[22] Filed: Mar. 21, 1994

[51] Int. Cl.[6] ..... A63B 23/04

[52] U.S. Cl. ..... 482/52

[58] Field of Search ..... 482/51, 52, 53, 111, 482/112, 83

[56] References Cited

U.S. PATENT DOCUMENTS 3,724,845 4/1973 Irby ..... 482/83

5,071,115 12/1991 Welch ..... 482/53

*Primary Examiner*—Stephen R. Crow

*Attorney, Agent, or Firm*—Michael I. Kroll

[57] ABSTRACT

An adjustable exercise device is provided for a child, which consists of a stationary support stand to be positioned on a flat surface. A handlebar assembly is mounted on the stationary support stand. A mechanism for simulation stepping motion is mounted to the stationary support stand. A child can grip the handlebar assembly with the hands and place the feet on the simulation stepping motion mechanism, so as to exercise by manually activating the simulation stepping motion mechanism.

9 Claims, 2 Drawing Sheets

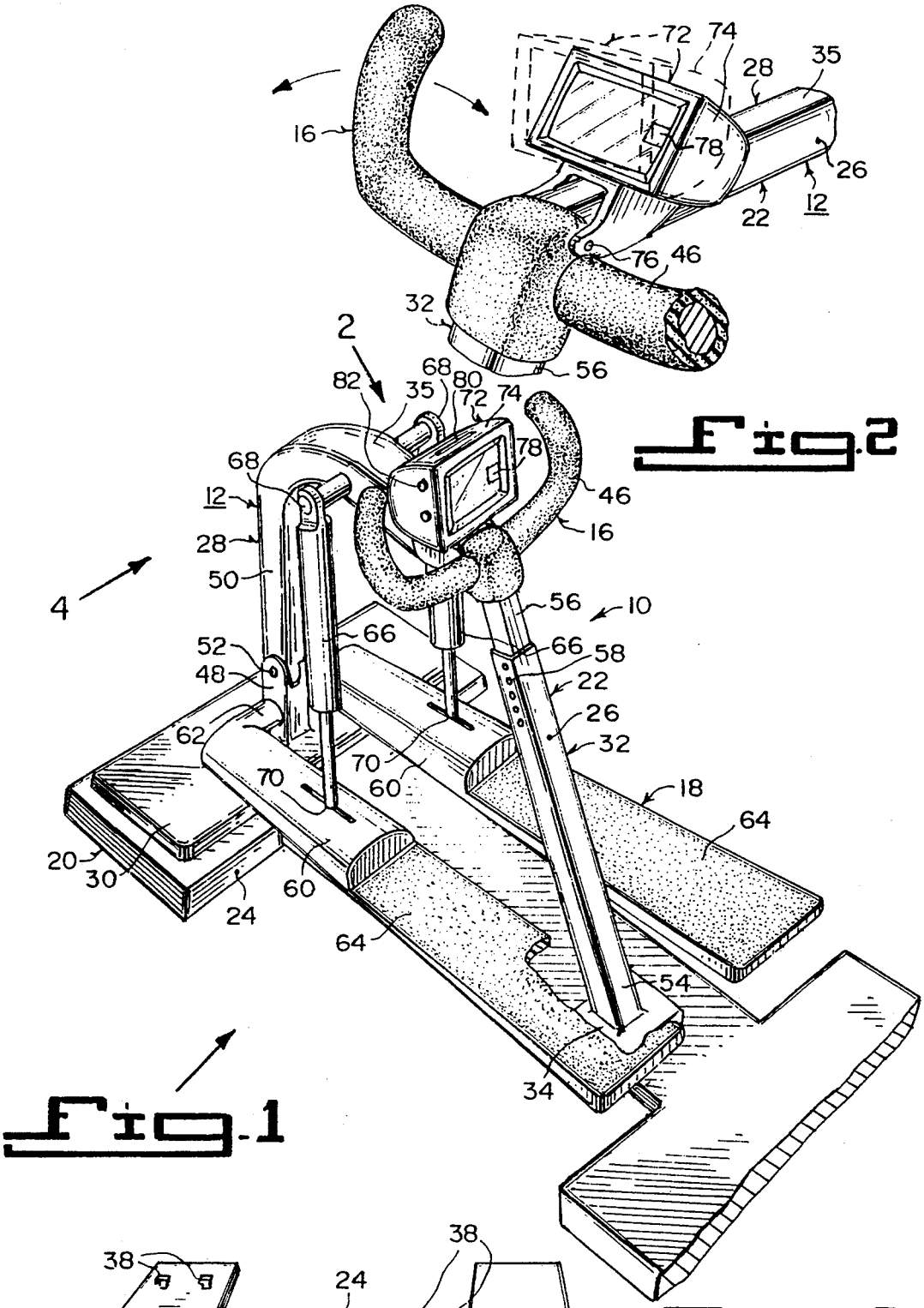
Fig. 2
Fig. 1
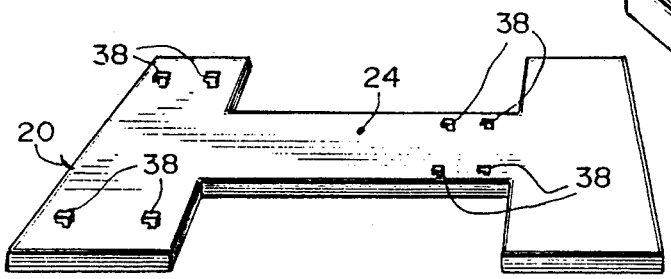
Fig. 3
(WEIGHTED BASE)

(ATTACHMENT TO WEIGHTED BASE)

ADJUSTABLE EXERCISE DEVICE FOR A CHILD

BACKGROUND OF THE INVENTION

1. Field of the Invention

The instant invention relates generally to exercising apparatuses and more specifically it relates to an adjustable exercise device for a child.

2. Description of the Prior Art

Numerous exercising apparatuses have been provided in prior art. For example U.S. Pat. Nos. 4,273,327 to Nall et al.; 4,595,195 to Miehlich; 4,605,221 to D'Agosta; 4,958,832 to Kim; 5,083,772 to Brown and 5,119,324 to Sain all are illustrative of such prior art. While these units may be suitable for the particular purpose to which they address, they would not be as suitable for the purposes of the present invention as heretofore described.

Nall, Clive
Long, Leo E.
Rigby, Sterling C.
Baugh, K. Boyd
Ski EXERCISING APPARATUS
U.S. Pat. No. 4,273,327

An apparatus for providing exercises to enhance muscle tone and coordination especially adapted for skiing enthusiasts. The apparatus consists of a tilt swivel board upon which the user stands. The tilt swivel board is formed with a planar top surface and a substantially convex bottom surface. Elastic extensible springs are anchored at one end to the tilt swivel board and pass through a harness belt adapted to be attached about the user's waist. Handles are provided at the other end of the springs for grasping by the user while bending the knees. Thereafter, body weight shifts between the legs and arm movements similar to those during skiing cause the swivel board to tilt and rock thereby imparting body motions similar to those encountered during skiing.

Miehlich, Dieter
Apparatus for Practicing Skiing
U.S. Pat. No. 4,595,195

An exercising apparatus for use by skiers to practice downhill runs, slalom runs and analogous types of runs has a main frame supporting a swaying frame which is turnable with reference to the main frame about two parallel horizontal axes extending longitudinally of the main frame. The movements of the swaying frame to either side of a central longitudinal vertical symmetry plane are opposed by strong coil springs whose bias is adjustable by a feed screw. The swaying frame carries a seesaw frame which is rockable with reference thereto about one or more horizontal axes disposed in the central longitudinal symmetry plane of the swaying frame. Two ski boot supporting platforms are mounted on the seesaw frame at the opposite sides of the symmetry plane of the swaying frame, and each such platform is tiltable about a longitudinally extending horizontal axis, turnable about a vertical axis and/or moveable lengthwise toward the front or rear end of the swaying frame, always against the opposition of one or more springs which tend to maintain the platform in a neutral position. The seesaw frame enables the user to move one of the platforms downwardly with attendant automatic upward movement of the other platform and vice versa, preferably against the opposition of one or more leaf springs.

D'Agosta, Nino
Exercise Method and Apparatus
U.S. Pat. No. 4,605,221

A method and apparatus for strengthening one's grip, wrist, arms and back includes providing a multi-leg exercise device having an upward extension for receiving light incremental disc weights, placing weights on the extension, positioning the device on a flat surface with two adjacent legs engaging the surface and defining a pivot axis therebetween, gripping one of the legs and rotating the device through a 90 degree arc between a lying stable position and standing stable position.

Kim, Sang-Sup
Stationary Exercising Bicycle Apparatus
U.S. Pat. No. 4,958,832

The disclosed stationary exercise bicycle apparatus has a road device unit supporting a substantially freewheeling endless treadmill, and a motion coordinator for coupling a substantially conventional bike unit with both its steering and drive wheels riding on the treadmill. The motion coordinator has a rail extended crosswise to and over the upper exposed run of the treadmill, and under the rotatable pedals of the bike unit. A pair of laterally rigid telescoping members are secured firmly between the bike unit and the rail. The securing structure includes a guide carried on the rail that holds the bike unit substantially fixed longitudinally on the treadmill and that allows lateral steering and limited tilting of the bike unit relative to the treadmill, to simulate riding the bike unit on a real road surface.

Brown, Lawrence G.
Exercising Apparatus
U.S. Pat. No. 5,083,772

Exercising apparatus for simulating the characteristics of exercise during actual riding of a bicycle comprising a stationary frame device for mounting apparatus components comprising a pedal operated drive system, fly wheel apparatus of relatively small size and weight operatively associated with the drive system and being operable thereby at relatively high velocities simulating momentum during actual riding of a bicycle, and resistance load applying apparatus operatively associated with the drive system for automatically applying variable resistance loads to the drive system in direct proportion to velocity of the drive system to simulate variations in resistance load encountered during actual riding of a bicycle.

Sain, Charles J.
Adjustably Variable Pedal
U.S. Pat. No. 5,199,324

A pedal assembly for bicycles, velocipedes, and the like is disclosed wherein the pedal is adjustably attached to the crank arm at a predetermined angle of inclination to or perpendicular to the crank arm. Rotation of the crank arm varies the angle of inclination of the pedal; the predetermined angle of inclination is the sum of first incremental angle provided by a beveled cam and a second incremental angle provided by an inclined pedal platform. Also disclosed is a quick-release pedal-and-cleat structure in the pedal assembly.

SUMMARY OF THE INVENTION

A primary object of the present invention is to provide an adjustable exercise device for a child that will overcome the shortcomings of the prior art devices.

Another object is to provide an adjustable exercise device for a child that is a step climber exercising machine, made of sturdy recyclable plastic material, which is especially sized to accommodate children between the ages of two to twelve years.

An additional object is to provide an adjustable exercise device for a child that comes equipped with a TV monitor located at the handlebar assembly that shows cartoons to entertain the child when utilizing the device.

A further object is to provide an adjustable exercise device for a child that is simple and easy to use.

A still further object is to provide an adjustable exercise device for a child that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of the instant invention.

FIG. 2 is a perspective view of a top portion of the instant invention taken in the direction of arrow 2 in FIG. 1.

FIG. 3 is a perspective view of the weighted base.

DETAILED DESCRIPTION OF THE PREFERRED EMBODIMENTS

Figure 4:
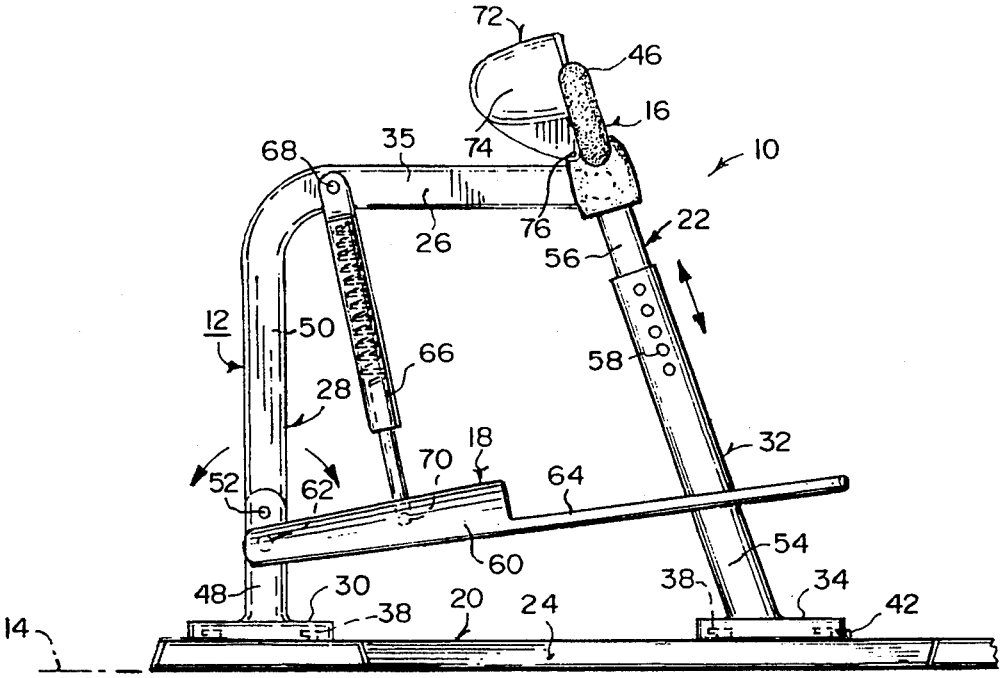
FIG. 4 is a side view taken in the direction of arrow 4 in FIG. 1.
Figure 5:
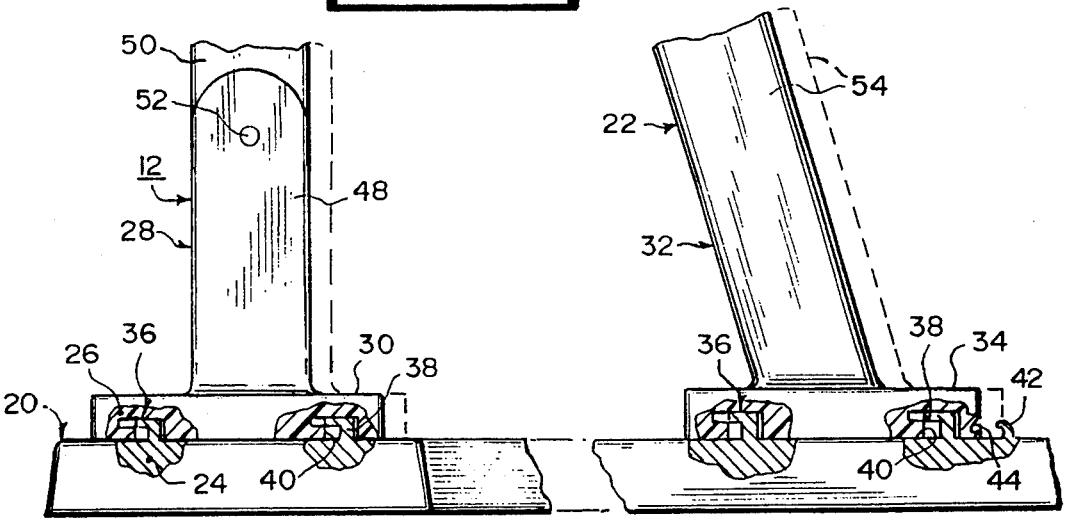
FIG. 5 is an enlarged side view of a bottom portion of the instant invention with parts broken away showing how the frame assembly attaches to the weighted base.

Turning now descriptively to the drawings, in which similar reference characters denote similar elements throughout the several views, FIGS. 1 through 5 illustrate an adjustable exercise device 10 for a child, which consists of a stationary support stand 12 to be positioned on a flat surface 14. A handlebar assembly 16 is mounted on the stationary support stand 12. A mechanism 18 for simulation stepping motion is mounted to the stationary support stand 12. A child can grip the handlebar assembly 16 with the hands and place the feet on the simulation stepping motion mechanism 18, so as to exercise by manually activating the simulation stepping motion mechanism 18.

The stationary support stand 12 includes a weighted base 20 and an upstanding frame 22 on the weighted base 20. The weighted base 20 is fabricated out of a metal material 24 and is in an I-shaped configuration, so as to stabilize the upstanding frame 22 on the flat surface 14. The upstanding frame 22 is fabricated out of sturdy recyclable plastic material 26.

The upstanding frame 22 contains a rear leg 28 having an elongated foot 30, a front leg 32 having a foot 34. Components 36 are for attaching the rear elongated foot 30 and the front foot 34 to the weighted base 20. The rear leg 28 is bent at a right angle, so that a top portion 35 of the rear leg 28 can extend over the weighted base 20 to the top of the front leg 32.

The attaching components 36 include a plurality of L-shaped hook members 38 on an upper rear surface and an upper middle front surface of the weighted base 20. The rear elongated foot 30 and the front foot 34 have a plurality of L-shaped slotted apertures 40 in a bottom surface to engage with the L-shaped hook members 38. The attaching components 36 can further include a curved stop member 42 on the upper middle front surface of the weighted base 20. The front foot 34 has a curved recess 44 in a front edge, to engage with the curved stop member 42, when the rear elongated foot 30 and the front foot 34 are fully attached to the weighted base 20.

The handlebar assembly 16 is mounted to the upstanding frame 22 at the juncture where the top portion 35 of the rear leg 28 meets the top of the front leg 32. The handlebar assembly 16 is adjustable and includes padding 46 thereon, so as to prevent accidental injury to the child using the device 10. The upstanding frame 22 is adjustable and consists of the rear leg 28 being separated into two segments 48 and 50.

A hinge 52 is located between the two segments 48, 50 of the rear leg 28. The front leg 32 is separated into two telescopic portions 54 and 56. A structure 58 is for locking the two telescopic portions 54 and 56 of the front leg 30 in one of any different height adjusted positions.

The simulation stepping motion mechanism 18 includes a pair of elongated pedals 60, each pivotally mounted at a rear end 62 to the lower segment 48 of the rear leg 28. A pair of non-slip foot pads 64 are provided, with each secured to a front end of one pedal 60 to prevent the feet of the child from slipping off the pedals 60. A pair of spring biased support members 66 are also provided, with each pivotally mounted at each end 68, 70 between the top portion 35 of the rear leg 28 and approximate the middle of one pedal 60, so as to suspend the pedals 60 above the weighted base 20.

A television monitor 72 has a housing 74 with a pivot hinge 76 mounted in an adjustable manner onto the handlebar assembly 16, so that the child exercising can look at cartoons while exercising. The television monitor 72 contains a display counter 78, to indicate to the child exercising, the amount of steps taken on the pedals 60.

The television monitor 72 further includes the housing 74 having a slot 80, so that a cartoon tape cartridge can be inserted into the slot 80 for viewing by the child. An eject button 82 is in the housing 74, for removing the cartoon tape cartridge from the slot 80 in the housing 74.

List of Reference Numbers

10 adjustable exercise device
12 stationary support stand
14 flat surface
16 handlebar assembly
18 simulation stepping motion mechanism
20 weighted base
22 upstanding frame
24 metal material in 20
26 sturdy recyclable plastic material in 22
28 rear leg
30 rear elongated foot
32 front leg
34 front foot
35 top portion of 28
36 attaching components
38 L-shaped hook member on 20
40 L-shaped slotted aperture in 30 and 34
42 curved stop member on 20

44 curved recess in 34
46 padding on 16
48 lower segment of 28
50 upper segment of 28
52 hinge between 48 and 50
54 lower telescopic portion of 32
56 upper telescopic portion of 32
58 locking structure
60 elongated pedal
62 pivot mount
64 non-slip foot pad on 60
66 spring biased support member
68 first pivot mount on 35
70 second pivot mount on 60
72 television monitor
74 housing of 72
76 pivot hinge on 74
78 display counter on 72
80 slot in 74
82 eject button in 74

What is claimed is new and desired to be protected by Letters Patent is set forth in the appended claims:

1. An adjustable exercise device for a child which comprises:

a) a stationary support stand to be positioned on a flat surface, said stand comprising a weighted base fabricated out of a metal material in an I-shaped configuration and an upstanding frame fabricated out of sturdy recyclable plastic material on said weighted base, said upstanding frame thereby being stabilized on a flat surface;

b) a handlebar assembly mounted on said stationary support stand;

c) means for simulating stepping motion mounted to said stationary support stand, so that a child can grip said handlebar assembly with the hands and place the feet on said simulation stepping motion means, so as to exercise by manually activating said simulation stepping motion means; and d) said upstanding frame including a rear leg having an elongated foot, a front leg having a foot, and means for attaching said rear elongated foot and said front foot to said weighted base.

2. An adjustable exercise device for a child as recited in claim 1, wherein said rear leg is bent at a right angle, so that a top portion of said rear leg can extend over said weighted base to the top of said front leg.

3. An adjustable exercise device for a child as recited in claim 2, wherein said attaching means includes:

a) a plurality of L-shaped hook members on an upper rear surface and an upper middle front surface of said weighted base; and b) said rear elongated foot and said front foot having a plurality of L-shaped slotted apertures in a bottom surface to engage with said L-shaped hook members.

4. An adjustable exercise device for a child as recited in claim 3, wherein said attaching means further includes:

a) a curved stop member on the upper middle front surface of said weighted base; and b) said front foot having a curved recess in a front edge to engage with said curved stop member when said rear elongated foot and said front foot are fully attached to said weighted base.

5. An adjustable exercise device for a child as recited in claim 4, wherein said handlebar assembly is mounted to said upstanding frame at the juncture where the top portion of said rear leg meets the top of said front leg.

6. An adjustable exercise device as recited in claim 5, wherein said handlebar assembly is adjustable and includes padding thereon, so as to prevent accidental injury to the child using said device.

7. An adjustable exercise device for a child as recited in claim 6, wherein said upstanding frame is adjustable and includes:

a) said rear leg being separated into two segments;

b) a hinge located between said two segments of said rear leg;

c) said front leg being separated into two telescopic portions; and d) means for locking said two telescopic portions of said front leg in one of any different height adjusted positions.

8. An adjustable exercise device as recited in claim 7, wherein said simulation stepping motion means includes:

a) a pair of elongated pedals, each pivotally mounted at a rear end to said lower segment of said rear leg;

b) a pair of non-slip foot pads, each secured to a front end of one said pedal to prevent the feet of the child from slipping off said pedals; and c) a pair of spring biased support members, each pivotally mounted at each end between said top portion of said rear leg and approximate the middle of one said pedal, so as to suspend said pedals above said weighted base.

9. An adjustable exercise device as recited in claim 8, further including a television monitor having a housing with a pivot hinge mounted in an adjustable manner onto said handlebar assembly, so that the child exercising can look at cartoons while exercising.

* * * * *